US005162291A

United States Patent [19]

Long et al.

[11] Patent Number: 5,162,291

[45] Date of Patent: Nov. 10, 1992

[54] SOLVENT FUSING OF THERMAL PRINTER DYE IMAGE

[75] Inventors: Michael E. Long, Penfield; David L. Van Galio, Brockport; Samuel S. Brody, Pittsford; Mark J. Robbins, Rochester, all of N.Y.

[73] Assignee: Eastman Kodak Company, Rochester, N.Y.

[21] Appl. No.: 851,404

[22] Filed: Mar. 12, 1992

Related U.S. Application Data

[63] Continuation of Ser. No. 712,819, Jun. 10, 1991, abandoned, and a continuation of Ser. No. 831,018, Feb. 4, 1992.

[51] Int. Cl.[5] ..... B41M 5/35; B41M 5/26

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,541,830 | 9/1985 | Hotta et al. | 8/471 |
| 4,720,480 | 1/1988 | Ito et al. | 503/227 |
| 4,923,860 | 5/1990 | Simons | 503/227 |
| 4,957,898 | 9/1990 | Weber | 503/227 |

FOREIGN PATENT DOCUMENTS 2083726 3/1982 United Kingdom .

*Primary Examiner*—Bruce H. Hess

*Attorney, Agent, or Firm*—Raymond L. Owens

[57] ABSTRACT

A method of solvent fusing thermal images is disclosed herein an inert gas is bubbled through a liquid solvent to vaporize the solvent. The solvent temperature is controlled. The vaporized solvent fuses the image.

7 Claims, 1 Drawing Sheet

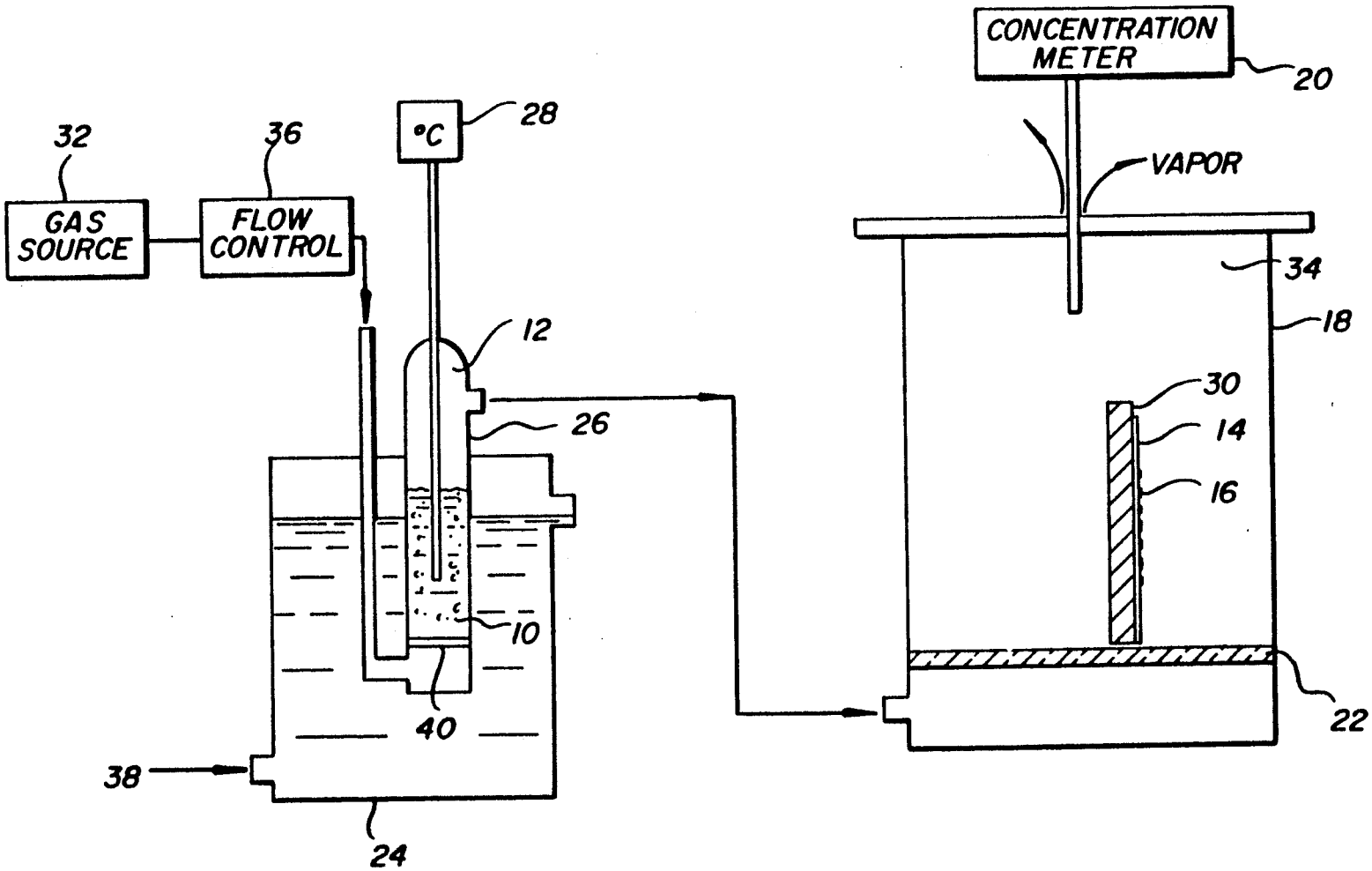
CONCENTRATION METER
20
VAPOR
34
18
22
30
14
16
26
28
°C
12
10
40
24
FLOW CONTROL
36
GAS SOURCE
32
38

SOLVENT FUSING OF THERMAL PRINTER DYE IMAGE

CROSS-REFERENCE TO RELATED APPLICATIONS

This application is a continuation of U.S. application No. 712,819 filed Jun. 10, 1991, now abandoned entitled "Solvent Fusing of Thermal Printer Dye Image" by Long et al and U.S. Ser. No. 831,018 filed Feb. 4, 1992 entitled "Solvent Fusing of Thermal Printer Dye Image" by Brody et al.

BACKGROUND OF THE INVENTION

1. Field of the Invention

The present invention relates to thermal printers and, more particularly, to fusing dye images in a receiver produced by such thermal printers.

2. Description of the Prior Art

Currently thermal dye transfers are usually followed by a fusing step to further "set" dye into the receiver. The term "thermal dye transfer" refers to all methods of transferring dye by thermal methods irregardless of whether the thermal energy is directly or indirectly generated and/or delivered, such as, but not inclusively resistive head, resistive ribbon, laser and ultrasonic thermal dye transfer. There generally are two technologies which are available for fusing. The first and most common is a thermal fusing process which involves reheating the receiver after thermal dye transfer. Because this technique uses thermal energy and generates a large amount of heat, generally a separate unit isolated from the heat sensitive donor is requires to perform this operation. This then requires a distinct two-step process and two separate units, one for image transfer and one for fusing which in turn increases time and costs of thermal imaging. Such heat fusing steps involve the possibility of damage to the receiver in the process of heat treating it to fix or fuse dyes.

Solvent fusing can eliminate the problem of damage to the receiver and also possible damage to the dye caused by subsequent heating steps. In heretofore solvent fusing steps, a receiver with a dye image transferred by thermal printing is placed in an enclosure adjacent to an open bath of solvent liquid. The liquid solvent vaporizes and this vapor impregnates the receiver and fuses the dye image into it.

In this method of solvent fusing, the solvent vapor concentration is dictated by the saturated vapor pressure of solvent at the ambient temperature. Sometimes, depending on the solvent being used, sufficient concentration can be reached which causes damage to the dye image. Another problem with this method is that with some solvents it is difficult to reach the appropriate concentration level to cause the solvent to impregnate the receiver to a sufficient extent so as to properly fix the dye image in the receiver within a reasonable time. When the receiver layer is positioned inside the enclosure, the solvent liquid-vapor equilibrium is lost due to loss of vapor. As solvent liquid evaporates to re-establish equilibrium concentration, the liquid is cooled by evaporative cooling which results in a lower vapor concentration than the original, until such time that the liquid has absorbed sufficient heat from the surroundings to again reach ambient temperature. As a result, this natural vapor-liquid equilibrium method of solvent fusing is substantially unregulatable or uncontrollable as it is affected by many variable factors including frequency of use, amount of vapor lost during receiver loading/unloading, liquid volume, vapor space volume, and construction material and configuration of enclosure.

SUMMARY OF THE INVENTION

It is an object of this invention to provide an controllable method for solvent fusing of thermal images which efficiently fuses thermally transferred dye images into a receiver without causing damage to such dyes or receivers.

This object is achieved in a method of fusing a thermally printed dye image in a receiver, comprising the steps of:

(a) placing the receiver in an enclosure;

(b) bubbling an inert gas through the controlled temperature liquid solvent to produce vaporized solvent; and (c) delivering such vaporized solvent into the enclosure in sufficient concentration to fuse the dye image in the receiver.

Features and advantages of the invention include the following:

1. Solvent fusing eliminates problems of thermal distortion of the dye receiver layer, and also eliminates dye loss through degradation or sublimination of dye which may result from heat fusing methods.

2. Fire hazard risks associated with the use of flammable solvents as the fusing solvent are reduced by use of inert gas as a carrier for the solvent vapor.

3. Solvent vapor of a constant concentration is supplied continuously to the enclosure containing the dye receiver layer from an external source, thereby providing a controllable fusing method.

4. Solvent vapor concentration can be controlled below the concentration that would result from solvent vapor and liquid being in equilibrium at ambient temperature in an enclosure, to prevent damage to an image which can occur with some solvents.

BRIEF DESCRIPTION OF THE DRAWINGS

The drawing is a schematic representation of apparatus for performing a method in accordance with the present invention.

DETAILED DESCRIPTION OF THE PREFERRED EMBODIMENT

In accordance with invention, a controlled concentration of solvent vapor is presented continuously to a receiver layer to fuse an image into the receiver. As illustrated in FIG. 1, a solvent vapor 12 is distributed uniformly by a flow of inert gas from gas source 32 such as nitrogen to a dye receiver layer 14 which is positioned inside enclosure 18. The dye receiver layer 14 contains a dye image 16 and has been coated on a dye receiver support layer 30. The solvent vapor 12 flows into the enclosure 18 through a distribution plate 22 to ensure uniform exposure of the receiver layer 14 to the solvent vapor 12 throughout the enclosure 18. Enclosure solvent vapor concentration 34 is monitored by a concentration meter 20 to confirm that aim concentration is maintained inside enclosure 18.

The solvent vapor is produced as follows. Inert gas from source 32 flows at a rate controlled by flow controller 36 into the bottom of bubble chamber 26. This gas is then introduced into the liquid solvent 10 through a bubble size reduction device 40, and flows upward through the liquid solvent 10 to produce solvent vapor 12. A predetermined concentration of solvent vapor 12 is produced by controlling the evaporation of solvent through gas flow rate, bubble size, gas-solvent liquid contact time and solvent liquid temperature.

Bubble chamber 26 is submersed in a vessel 24 through which temperature controlled water 38 is circulated to accurately control solvent liquid 10 temperature. If mass transfer parameters of the evaporation process are controlled such that vapor-liquid equilibrium is attained, the maximum vapor concentration attainable will be a function only of the saturated vapor pressure of the solvent at the liquid solvent temperature. When the fusing method is operated in this manner, solvent liquid temperature must be controlled so that the solvent vapor temperature is less than the dye receiver layer 14 temperature to avoid condensation and thus damage to the dye receiver. The concentration of the solvent vapor is selected so that it does not exceed its saturated or equilibrium vapor pressure. In this way, condensation of solvent is prevented in the receiver.

Any solvent which will dissolve the dye receiver layer and the dye layer can be used as the fusing solvent. Both solvent vapor concentration and exposure time of the dye receiver layer to the solvent vapor are important for achieving effective fusing of the dye into the receiver layer. Effective fusing is characterized by complete fixing of the dye into the receiver layer with no significant distortion of the dye image. The dye must be fixed to an extent such that no significant quantity of dye can be removed from the surface of the receiver layer when washed with a solvent capable of dissolving only the dye. Since the rate at which a dye receiver and a dye are dissolved varies between different solvents, the vapor concentration and exposure time required for effective fusing also varies from solvent to solvent. Aggressive solvents which quickly solubilize a receiver and dye may cause distortion of the dye images at the concentration reached at equilibrium ambient temperature in an enclosure in less time than is practical for application. The present invention provides a controllable means of exposing a dye receiver layer to a solvent vapor concentration below that obtained by allowing liquid solvent to equilibrate in an enclosure at ambient temperature. Certain solvents which are capable of dissolving the receiver layer and dye when they are contacted with the solvent liquid phase, may not provide effective fusing due to the low concentration attainable at process temperatures as a result of their low vapor pressure. Preferably a solvent with a vapor pressure above 50mm Hg at a temperature below 20 degrees centigrade is used to reduce fusing exposure time required for efficient fusing of the dye into the receiver layer. The selection of solvent from the group consisting of $CH_2CL_2$ and $CH_3COC_2H_5$ is preferred.

Any sublimable dye can be used provided it has been transferred to the dye image receiver layer by the action of heat. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalong Polyol Brilliant Blue N-BGM® and KST Black 146® (products of Nippon Kayaku Co., Ltd.), azo dyes such as Kayalong Polyol Brilliant Blue BM®, Kayalong Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (produces of Nippon Kayaku Co., Ltd.); acid dyes such as Kayanol Milling Cyanine 5R® (product of Nippon Kayaku Co., Ltd.); basic dyes such as Sumicacryl Blue 6G® (product of Sumitomo Chemical Co., Ltd.), and Aizen Malachite Green® (product of Hodogaya Chemical Co., Ltd.); or any of the dyes disclosed in U.S. Pat. No. 4,541,830, the disclosure of which is hereby incorporated by reference.

The dye receiver layer 14 can be a commercially available polycarbonate or polyester which is capable of having a dye thermal transferred and fused into it and can be coated on a dye support layer 16 such as paper.

EXAMPLE

In an example according to this invention, unfused red, green and blue dye images were formed in a polycarbonate receiver by thermal transfer. These images were then exposed to a molar solvent vapor concentration of 34% in nitrogen gas for four minutes. The vapor concentration of 34 mole % was determined by calculating the ratio of the vapor pressure of the solvent at the process temperature to the total pressure. The fused images were washed with methanol and were unaffected. Similar washing of unfused images resulted in complete removal of dye.

The solvent used was $CH_2Cl_2$ at a controlled temperature of 14 degrees centigrade. Nitrogen flow was controlled at 0.5 liters/minute by a rotameter. The chamber solvent temperature was allowed to rise to 18 degrees centigrade. Bubble size was reduced by flowing the gas through a scintered glass plate in a 5.0cm diameter glass bubbler tube with a liquid height of 10cm. The fusing enclosure, denoted as 18 in FIG. 1, had a 2.5 liter volume with a scintered glass bottom for dispersing the vapor uniformly. Solvent vapor concentration in the fusing enclosure was monitored by means of a matheson model 8017 thermal conductivity gas leak detector modified with a decreased gain setting to provide high concentration monitoring capabilities.

The invention has been described in detail with particular reference to a preferred embodiment thereof, but it will be understood that variations and modifications can be effected within the spirit and scope of the invention.

What is claimed is:

1. A method of fusing a thermal printing dye image in a receiver, comprising the steps of:

(a) placing the receiver in an enclosure;

(b) controlling the temperature of a liquid solvent exposed in a container;

(c) bubbling an inert gas through the solvent at a quantity and rate selected to vaporize the solvent so as to produce a predetermined concentration of solvent; and (d) delivering such vaporized solvent into the enclosure in a sufficient amount so that the concentration in the enclosure is regulated to fuse the dye image in the receiver while at the same time not damaging such image.

2. The method as set forth in claim 1 wherein the inert gas is nitrogen and the solvent is selected from the group consisting of $CH_2Cl_2$ and $CH_3COC_2H_5$.

3. The method as set forth in claim 1 wherein the solvent liquid temperature is controlled so that the solvent vapor temperature is less than that of the dye receiver.

4. The method as set forth in claim 1 wherein the concentration of the solvent vapor is selected so that it does not exceed its saturated or equilibrium vapor pressure to prevent condensation in the receiver.

5. A method of fusing a thermal printing dye image in a receiver, comprising the steps of:

(a) placing the receiver in an enclosure;

(b) controlling the temperature of a liquid solvent exposed in a container;

(c) bubbling an inert gas through the solvent at a quantity and rate selected to vaporize the solvent so as to produce a predetermined concentration of solvent; and (d) delivering such vaporized solvent into the enclosure in a sufficient amount so that the concentration in the enclosure is regulated to fuse the dye image in the receiver while at the same time not damaging such image.

6. The method as set forth in claim 5 wherein the solvent liquid temperature is controlled so that the solvent vapor temperature is less than that of the dye receiver.

7. The method as set forth in claim 6 wherein the concentration of the solvent vapor is selected so that it does not exceed its saturated or equilibrium vapor pressure to prevent condensation in the receiver.

* * * * *